US008226183B2

(12) United States Patent
Kang et al.

(10) Patent No.: US 8,226,183 B2
(45) Date of Patent: Jul. 24, 2012

(54) REFRIGERATOR

(75) Inventors: Byeong-Gyu Kang, Changwon (KR); Jae-Youl Lee, Changwon (KR); Sang-Ho Park, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/730,133

(22) Filed: Mar. 23, 2010

(65) Prior Publication Data

US 2010/0231111 A1 Sep. 16, 2010

Related U.S. Application Data

(63) Continuation of application No. 12/596,633, filed as application No. PCT/KR2008/002113 on Apr. 15, 2008, now abandoned.

(30) Foreign Application Priority Data

Apr. 20, 2007 (KR) ..... 10-2007-0038695

(51) Int. Cl.
*A47B 96/04* (2006.01)
*E05D 15/00* (2006.01)
*E05D 15/28* (2006.01)

(52) U.S. Cl. ..... 312/405; 312/329; 16/362; 49/246

(58) Field of Classification Search ..... 312/326, 312/329, 405, 325; 16/239, 362, 368; 49/246, 49/247, 248, 249, 250, 252, 260, 261
See application file for complete search history.

(56) References Cited

U.S. PATENT DOCUMENTS

| | | | | | |
|---|---|---|---|---|---|
| 4,411,046 | A * | 10/1983 | Nawrath | 16/354 |
| 4,727,622 | A * | 3/1988 | Tsuneki | 16/368 |
| 4,827,569 | A * | 5/1989 | Mertes | 16/288 |
| 4,979,265 | A * | 12/1990 | Grass | 16/291 |
| 5,040,857 | A * | 8/1991 | Mandel et al. | 312/405 |
| 5,535,482 | A * | 7/1996 | Grabber | 16/286 |
| 6,402,270 | B1 * | 6/2002 | Frank | 312/138.1 |
| 7,406,749 | B2 * | 8/2008 | Herper | 16/368 |
| 7,836,553 | B2 * | 11/2010 | Brouwer et al. | 16/354 |
| 2010/0018122 | A1 * | 1/2010 | Hecht et al. | 49/31 |
| 2010/0231111 | A1 * | 9/2010 | Kang et al. | 312/405 |
| 2010/0283367 | A1 * | 11/2010 | Coleman et al. | 312/405 |

FOREIGN PATENT DOCUMENTS

| | | | |
|---|---|---|---|
| JP | 2004-325051 | A | 11/2004 |
| KR | 1997-0022158 | A | 5/1997 |
| KR | 10-0457981 | B1 | 11/2004 |
| KR | 10-2006-0122500 | A | 11/2006 |

* cited by examiner

*Primary Examiner* — Darnell Jayne
*Assistant Examiner* — Daniel Rohrhoff
(74) *Attorney, Agent, or Firm* — Birch, Stewart, Kolasch & Birch, LLP

(57) ABSTRACT

A refrigerator is provided. The refrigerator includes a main body defining a storage chamber, a door opening and closing the storage chamber, and a pivot guide unit connecting the door to the main body and varying a distance between a pivot shaft of the door and the main body in response to a pivot motion of the door.

7 Claims, 7 Drawing Sheets

REFRIGERATOR

CROSS-REFERENCE TO RELATED APPLICATIONS

This application is a continuation of prior application Ser. No. 12/596,633, filed Oct. 19, 2009, which is a national stage application of International Patent Application No. PCT/KR08/02113, filed Apr. 15, 2008, which claims the benefit of Korean Patent Application No. 10-2007-0038695, filed Apr. 20, 2007, all of which are herein incorporated by reference in their entireties.

BACKGROUND OF THE INVENTION

1. Field of the Invention

The present disclosure relates to a refrigerator.

2. Description of Related Art

Refrigerators are appliances maintained at a low temperature in order to slow down the rate of decay of food. The refrigerators are classified into top mount type refrigerators having a freezing compartment formed at an upper side and a refrigerating compartment formed at a lower side, side-by-side type refrigerators having freezing and refrigerating compartments disposed at left and right sides, and bottom freezer type refrigerators having a refrigerating compartment formed at an upper side.

A typical refrigerator includes a main body defining a storage chamber and a door for opening/closing the storage chamber. The door is pivotally connected to the main body by a pivot guide unit.

When the refrigerator is installed in a built-in type or installed near other objects such as furniture or electronic devices, the door may interfere with the object around the refrigerator during pivoting. In this case, the door may be damaged or the pivot angle of the door may be limited.

DISCLOSURE

Technical Problem

Embodiments provide a refrigerator that is designed to allow a door to effectively pivot even when the refrigerator is installed in a built-in type or installed in other electronic devices or furniture.

Embodiments also provide a refrigerator that is designed to increase a pivot angle of a door and thus to allow the door to effectively pivot.

Technical Solution

In an embodiment, a refrigerator includes a main body defining a storage chamber; a door opening and closing the storage chamber; and a pivot guide unit connecting the door to the main body and varying a distance between a pivot shaft of the door and the main body in response to a pivot motion of the door.

In another embodiment, a refrigerator includes a main body defining a storage chamber; a door opening and closing the storage chamber; and a pivot guide unit pivotally connecting the door to the main body, wherein the pivot guide unit includes a transfer unit that is connected to the door to transfer pivot force of the door and a shaft moving unit that is connected to a pivot shaft moves a pivot shaft of the door by receiving the pivot force of the door from the transfer unit.

In still another embodiment, a refrigerator includes a main body defining a storage chamber; a door opening and closing the storage chamber; and a pivot guide unit pivotally connecting the door to the main body, wherein the pivot guide unit includes a first guide unit that is connected to the door by a pivot shaft to allow the pivot shaft to move relative to the main body; and a second guide unit operating the first guide unit in response to pivot motion of the door.

Advantageous Effects

According to the embodiments, since the door is spaced apart from a front surface of the main body as it starts pivoting to open the storage chamber, the door can be effectively opened even when the refrigerator is installed near other objects such as furniture.

Further, since a pivot angle of the door increases, limitation of an installation location of the refrigerator can be reduced.

The details of one or more embodiments are set forth in the accompanying drawings and the description below. Other features will be apparent from the description and drawings, and from the claims.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Reference will now be made in detail to the embodiments of the present disclosure, examples of which are illustrated in the accompanying drawings.

Figure 1:
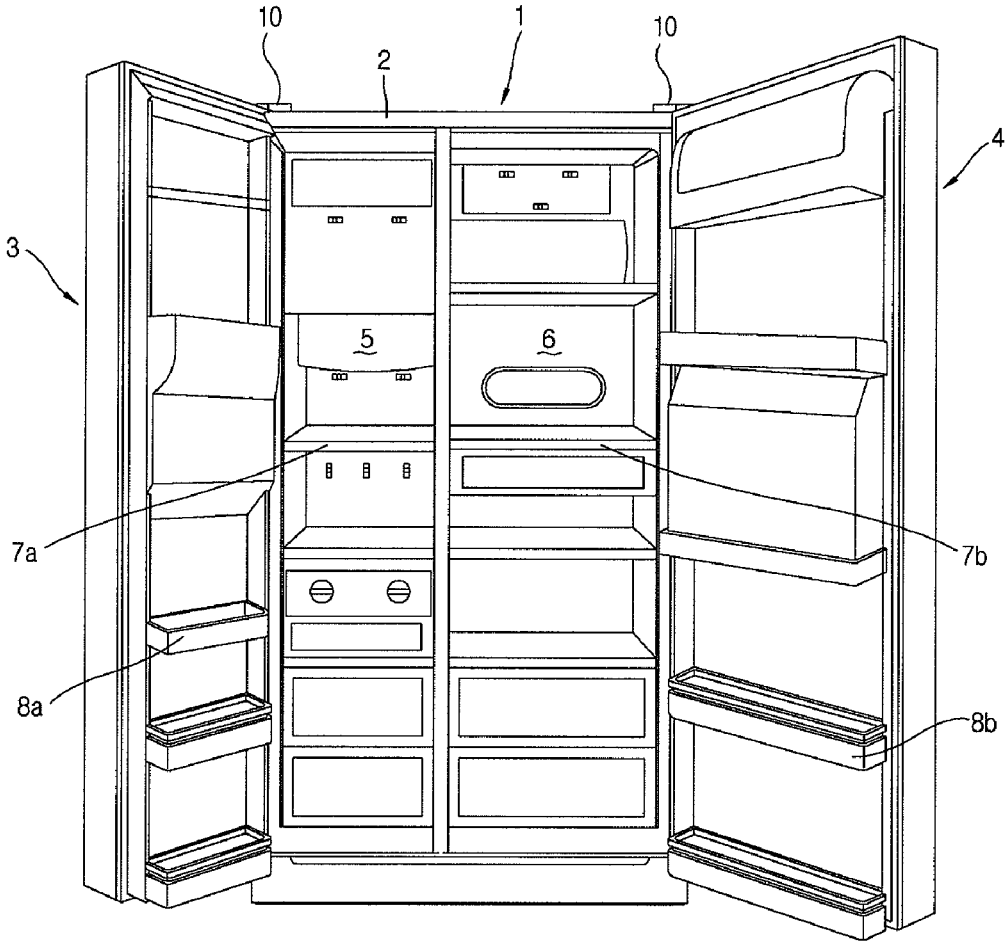
FIG. 1 is a perspective view of a refrigerator according to an embodiment of the present disclosure, when a door is opened.

FIG. 1 is a perspective view of a refrigerator according to an embodiment of the present disclosure, when a door is opened.

In FIG. 1, a side-by-side type refrigerator is exemplarily illustrated. However, the present disclose is not limited to the side-by-side type refrigerator. That is, a concept of the present disclosure may be applied to any types of the refrigerators having a door that is pivotally coupled.

Referring to FIG. 1, a refrigerator 1 of an embodiment of the present disclosure includes a main body 2 defining a storage chamber and doors 3 and 4 that are pivotally coupled to the main body 2 by pivot guide units 10.

The storage chamber includes a freezing compartment 5 and a refrigerating compartment 6. The door 5 will be referred to as freezing door for opening and closing the freezing compartment 5 and the door 4 will be referred to as refrigerating door for opening and closing the refrigerating compartment 6.

A plurality of shelves 7*a* are provided in the freezing compartments 5 to divide the inner space of the freeing compartments into a plurality of chambers. A plurality of shelves 7*b* are provided in the refrigerating compartment 6 to divide the inner space of the refrigerating compartments into a plurality of chambers. A plurality of baskets 8*a* for storing foods are provided on an inner wall of the freezing door 3. A plurality of baskets 8*b* for storing foods are provided on an inner wall of the refrigerating door 4.

The following will describe the pivot guide unit 10 in detail.

Figure 2:
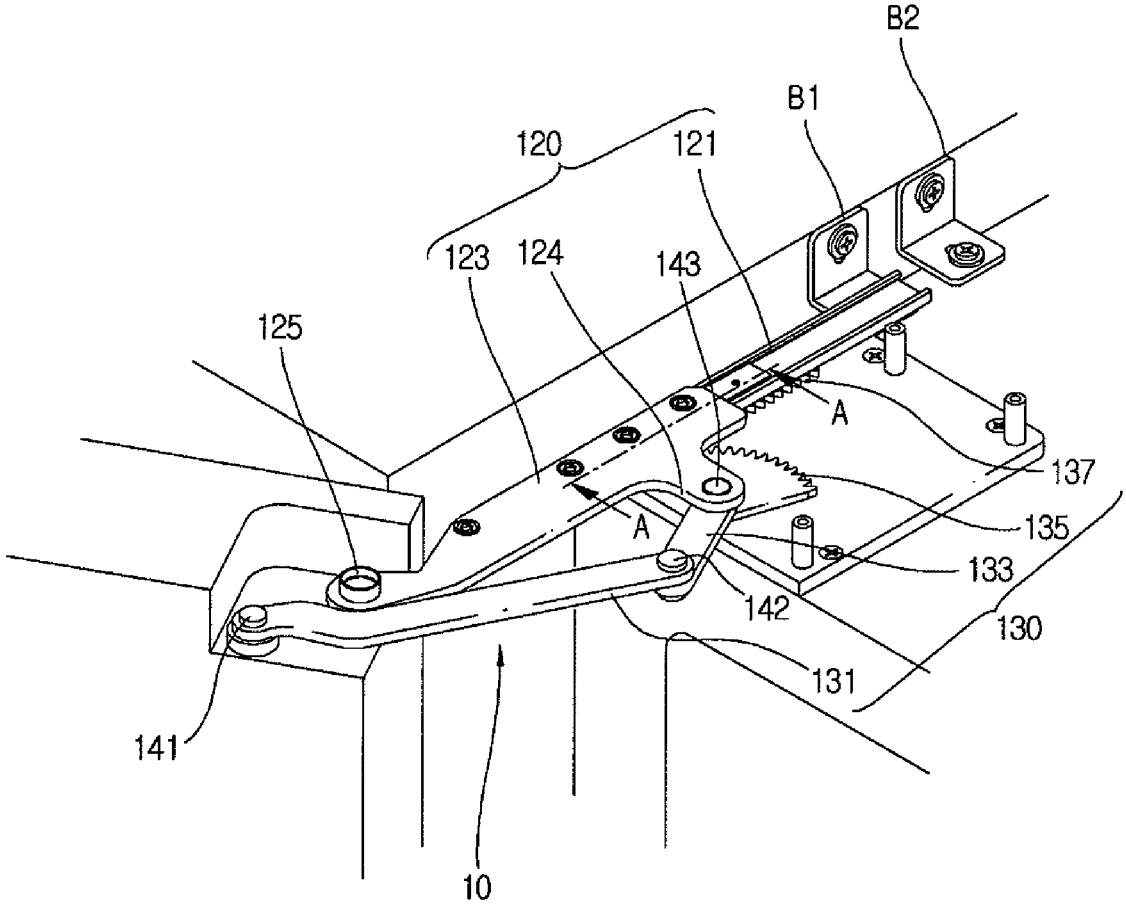
FIG. 2 is a perspective view of a pivot guide unit according to an embodiment of the present disclosure.
Figure 3:
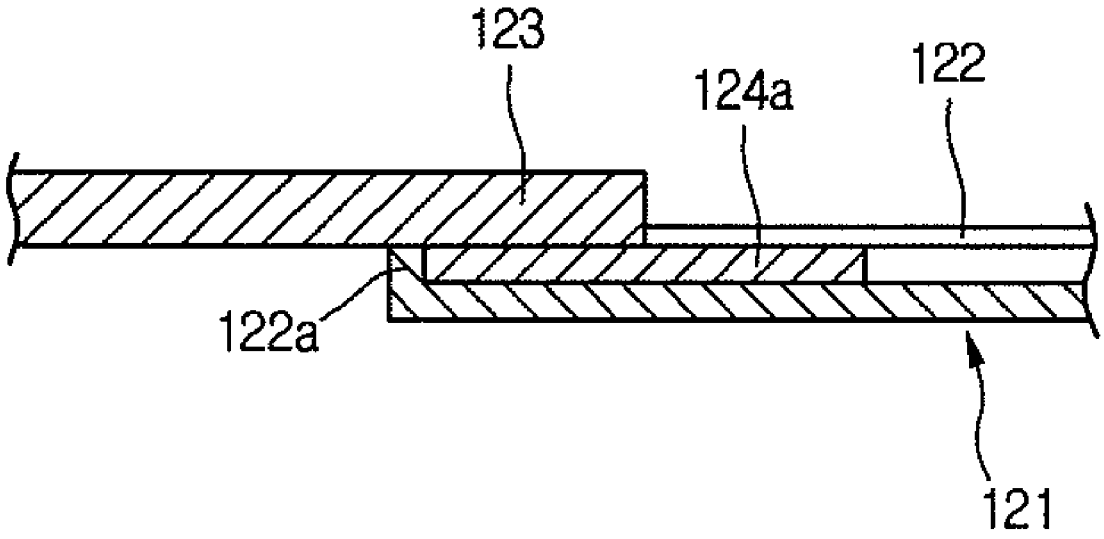
FIG. 3 is a cross-sectional view taken along line A-A of FIG. 2.

FIG. 2 is a perspective view of the pivot guide unit of FIG. 1 and FIG. 3 is a cross-sectional view taken along line A-A of FIG. 2.

In the following description, the concept of the embodiment will be described with reference to only the door 3.

Referring to FIGS. 2 and 3, the refrigerator 1 may be fixed on a peripheral object A by brackets B1 and B2. The pivot guide unit 10 is installed on the door 3 and the main body 2.

The pivot guide unit 10 includes an installation plate 111 installed on the main body 2, a first guide unit that is installed on the installation plate 111 and connected to the door 3 for translation motion of a pivot shaft 125 relative to a front surface 2*a* of the main body 2, and a second guide unit 130 that is connected to the door 3 to transfer rotational force of the door 3 to the first guide unit 120.

Since the first guide unit 120 allows the pivot shaft 125 to move toward or away from the front surface of the door 3, the first guide unit 120 may be referred to as shaft moving unit. Since the second guide unit 130 transfers the rotational force of the door 3 to the first guide unit 120, the second guide unit 130 may be referred to transfer unit.

The first guide unit 120 includes a guide rail 121 installed on the installation plate 111 and a sliding member 123 coupled to the guide rail 121 and translated. The sliding member 123 is connected to the door 3 by the pivot shaft 125. The pivot shaft 125 may be formed on one of the sliding member 123 and the door 3.

For example, in the present embodiment, the sliding member 123 is translated relative to the main body 2 so that the pivot shaft 125 can move frontward at the front surface of the main body 2 in a direction perpendicular to the front surface of the main body 2. The sliding member 123 and the guide rail 121 formed to extend in a front-rear direction of the main body 2.

The sliding member 123 is coupled to the second guide unit 130 by a coupling unit 124.

The sliding member 123 is provided with a first guide portion 124a and the guide rail 121 is provided with a second guide portion 122 engaged with the first guide portion 124*a*. A stopper 122*a* is formed on a front end portion of the guide rail 124*a* to catch the sliding member 123 when the sliding member moves frontward of the main body 2 by a predetermined length. When the first guide portion 124*a* is caught by the stopper 122*a*, the sliding member 123 stops moving.

The second guide unit 130 includes a link unit that is pivotally connected to the door 3 by a first hinge shaft 141, a movable gear 135 connected to the link unit and rotating together with the link unit, and a stationary gear 137 engaged with the movable gear 135.

The link unit includes a first link member 131 connected to the door 3 and a second link member 133 pivotally connected to the first link member 131 by a second hinge shaft 142.

The installation plate 111 may be installed on the stationary gear 137. The stationary gear 137 is formed in parallel with the guide rail 121. The movable gear 135 rotates in a state where it is engaged with the stationary gear 137. The movable gear 135 is formed in a fan-shape. A rack gear may be used as the stationary gear 137 and a pinion gear may be used as the movable gear 135.

The second link member 133 may be pivotally coupled to the coupling portion 124 of the sliding member 123 by a connecting member 143. Therefore, the connecting member 143 functions as a pivot shaft of the second link member 133.

Here, the second link member 133 may be integrally formed with or coupled to the movable gear 135. Therefore, the connecting member 143 penetrates at least the second link member 133 and the coupling portion 124.

The second link member 133 may be coupled to the movable gear 135 by the connecting member 143. In this case, the connecting member 143 simultaneously penetrates the coupling portion 124, the second link member 133, and the movable member 135. The connecting member 143 functions as a pivot axis of the movable gear 135.

When the movable gear 135 rotates together with the second link member 133 in a state where the movable gear 135 is engaged with the stationary gear 137, the connecting member 143 is translated frontward and rearward as the movable gear 135 rotates. Therefore, the sliding member 123 is translated frontward and rearward.

The following will describe operation of the pivot guide unit 10 in accordance with the pivot motion of the door 3.

Figure 4:
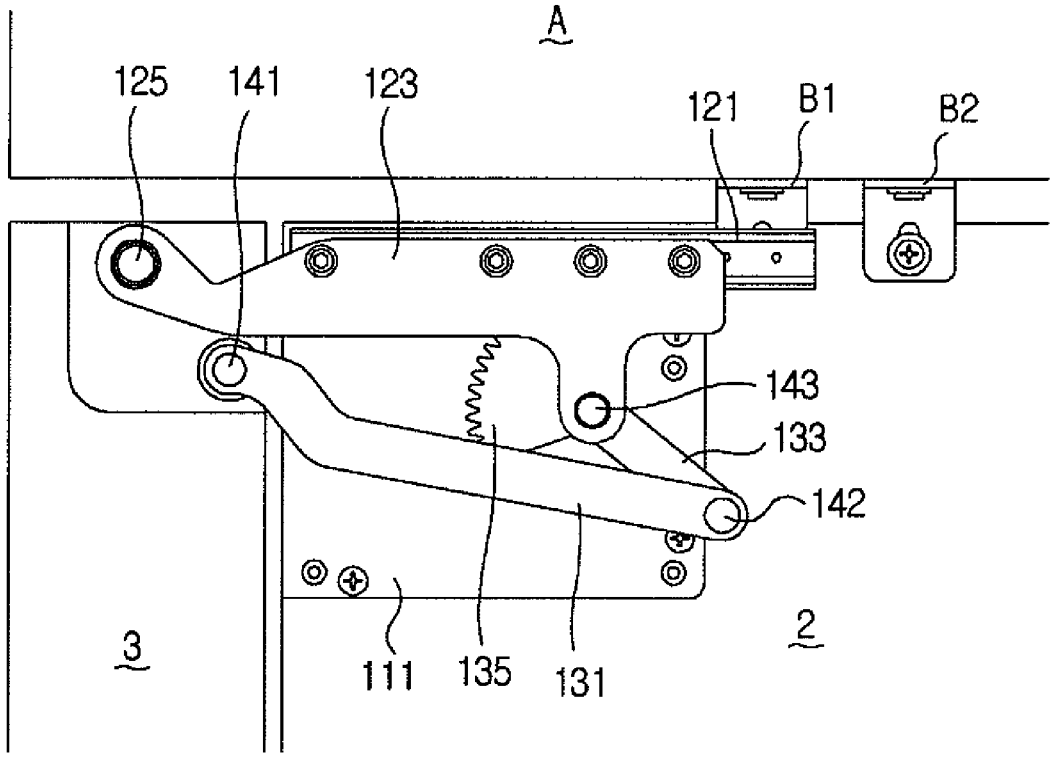
FIG. 4 is a top plan view of a refrigerator according to an embodiment of the present disclosure, when a door closes a storage chamber.
Figure 5:
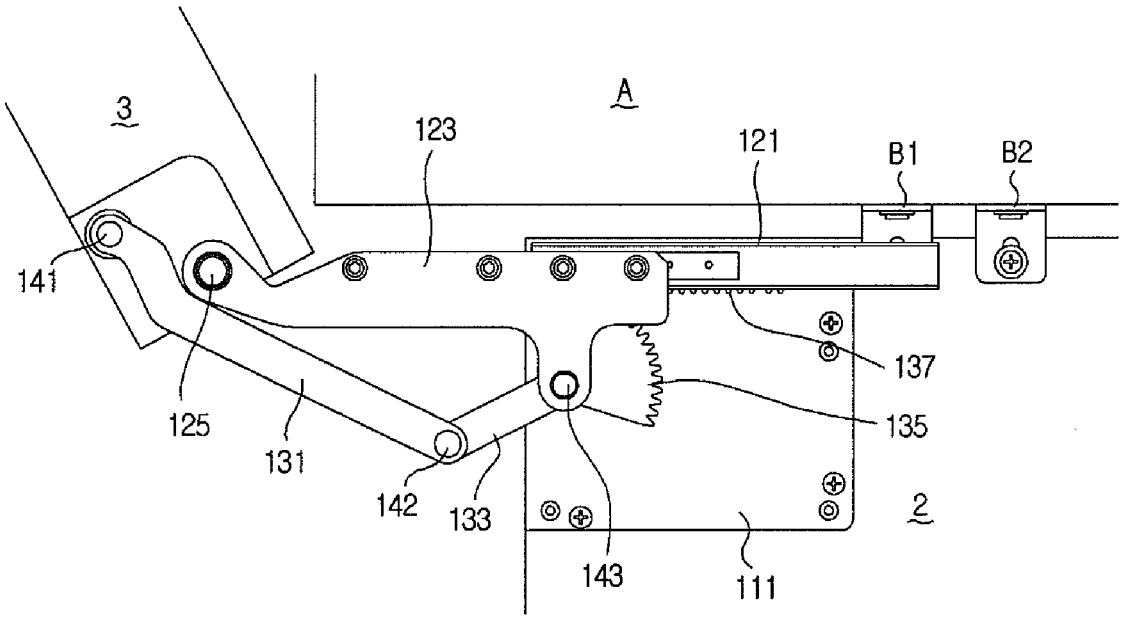
FIG. 5 is a top plan view of a refrigerator according to an embodiment of the present disclosure, when a door opens a storage chamber.

FIG. 4 is a top plan view of the refrigerator when the door closes the storage chamber and FIG. 5 is a top plan view of the refrigerator when the door opens the storage chamber.

Referring to FIGS. 4 and 5, when the door 3 is pulled to open the storage chamber, the door 3 pivots about the pivot shaft 125 and, at the same time, the first hinge shaft 141 gradually moves away from the front surface 2*a* of the main body 2.

Then, the first link member 131 connected to the first hinge shaft 141 rotates together with the first hinge shaft 141. When the first link member 131 moves to pull the second link member 133, the second line member 133 and the movable gear 135 rotate. That is, the first link member 131 transfers the rotational force of the door 3 to the second link member 133 and the movable gear 135.

When the movable gear 135 rotates in a state where it is engaged with the stationary gear 137, the connecting member 143 linearly moves toward the front portion of the main body 2. As a result, the sliding member 123 linearly moves toward the front portion of the main body 2 and thus the pivot shaft 125 moves away from the front surface 2*a* of the main body 2 in a direction perpendicular to the front surface 2*a*. That is, a distance between the pivot shaft 125 and the front surface 2*a* of the main body 2 gradually increases as the door 3 is gradually opened.

At this point, when the door 3 pivots by an angle less than a predetermined angle, the pivot shaft 125 gradually moves away from the front surface 2*a* of the main body 2. When the door 3 pivots over the predetermined angle, the distance between the pivot shaft 125 and the front surface 2*a* of the main body 2 is uniformly maintained and only the pivot angle of the door 3 increases.

That is, when the door 3 pivots over the predetermined angle, the first guide portion 124*a* is caught by the stopper 122*a* to stop the movement of the sliding member 123. Therefore, the door 3 simply pivots about the pivot shaft 125.

Therefore, according to the present embodiment, upon the rotation of the door 3, the pivot shaft 125 of the door moves away from the front surface 2*a* of the main body 2. Therefore, even when the refrigerator is installed near other objects such as furniture, the door 3 can be effectively opened.

In addition, since the pivot angle of the door 3 increases, the limitation of the installation location of the refrigerator can be reduced.

Figure 6:
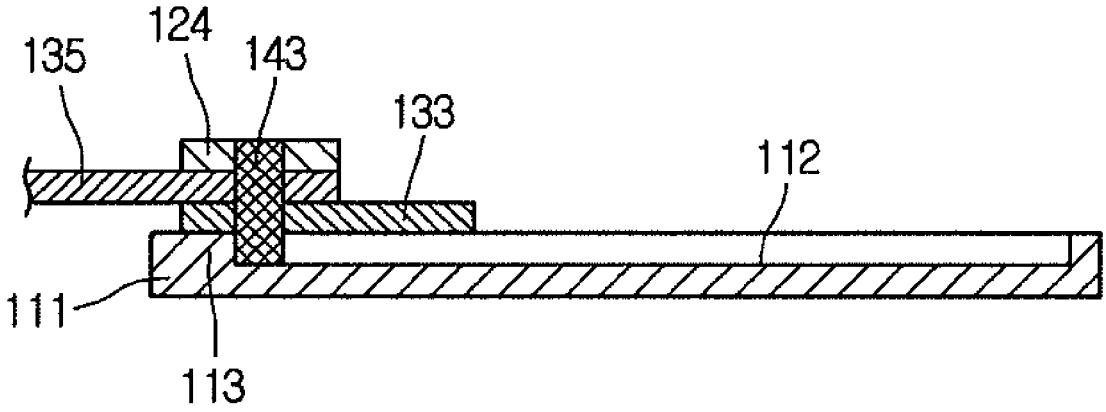
FIG. 6 is a cross-sectional view of a structure for stopping a sliding member according to another embodiment of the present disclosure.

FIG. 6 is a cross-sectional view of a structure for stopping the sliding member according to another embodiment, taken in a vertical direction of the connecting member of FIG. 2.

This embodiment is substantially identical to the foregoing embodiment of FIGS. 1 through 6 except for a structure for stopping the sliding member. Therefore, in this embodiment, parts identical to those of the foregoing embodiment will not be described.

Referring to FIG. 6, a connecting member simultaneously penetrates a coupling portion 124 of a sliding member 123, a second link member 133, and a movable gear 135. The installation plate 111 is provided with a guide groove 112 in which the connection member 143 penetrating the movable gear 135 is partly inserted. The guide groove 112 is formed to extend in a front-rear direction of the main body 2. Therefore, the connecting member 143 is translated frontward and rearward in a state where it is inserted in the guide groove 112.

As the door 3 pivots, the sliding member 123 moves, in the course of which, when the connecting member 143 is caught by a front wall (i.e., a stopper 133) of the guide groove 112, the connecting member stops moving and thus the sliding member also stops moving.

Figure 7:
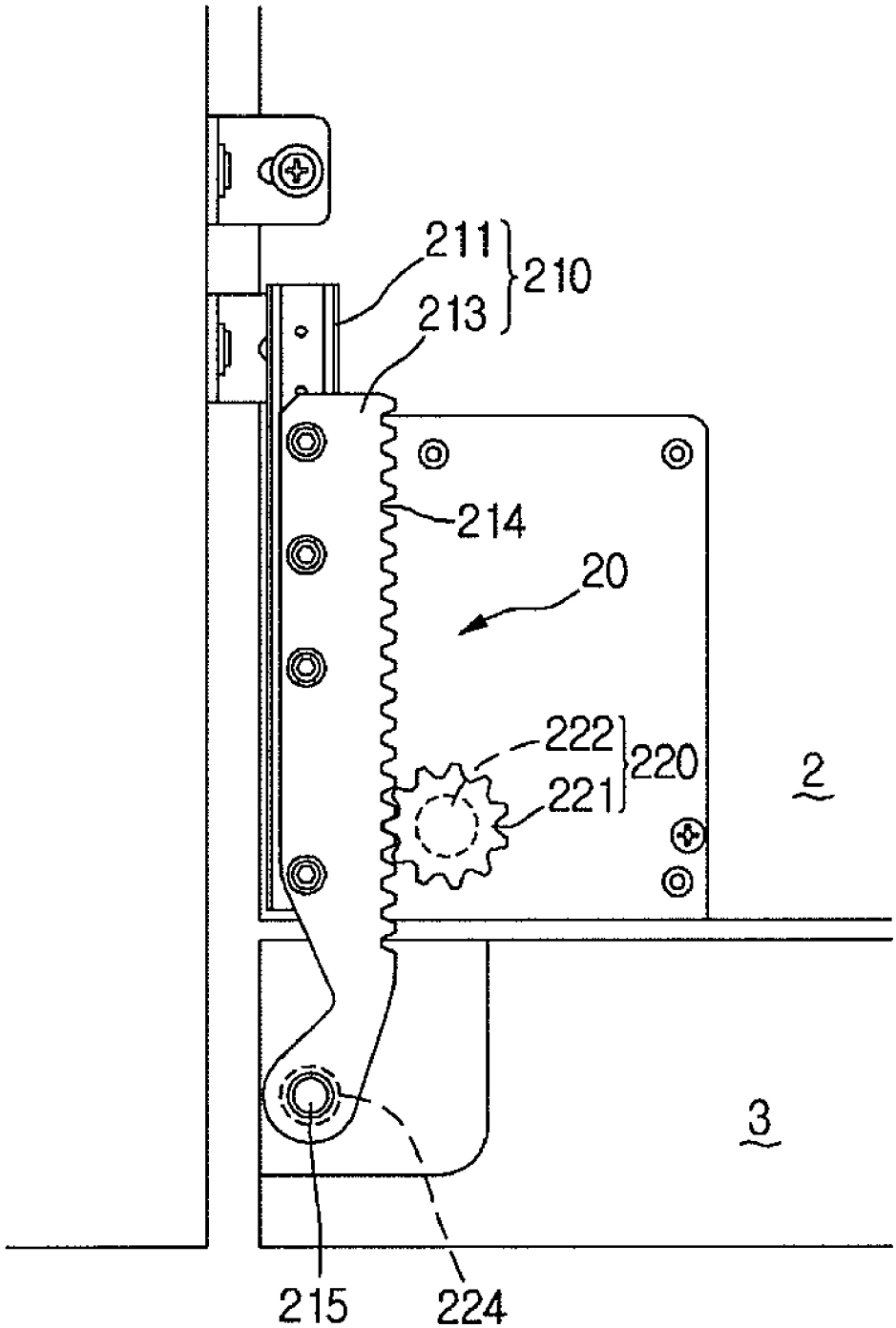
FIG. 7 is a top plan view of a pivot guide unit of a refrigerator according to another embodiment of the present disclosure.

FIG. 7 is a top plan view of a pivot guide unit of a refrigerator according to another embodiment of the present disclosure.

This embodiment of FIG. 7 is substantially same as the embodiment of FIGS. 1 through 5 except for a structure of the second guide unit for operating the first guide unit. Therefore, in this embodiment, only the difference will be described.

Referring to FIG. 7, a pivot guide unit 20 of this embodiment includes a first guide unit 210 that is connected to the door 3 to provide a pivot axis of the door 3 and enables a pivot shaft 215 to be translated frontward and rearward and a second guide unit 220 that operates the first guide unit 210 by detecting the pivot motion of the door 3.

The first guide unit 210 includes a guide rail 211 and a sliding member 213 that is translated along the rail 211. The door 3 is pivotally connected to the sliding member 213 by the pivot shaft 215.

The first guide unit 220 includes a detecting portion 224 for detecting the pivot motion of the door 3, a driving motor 221 operating in accordance with information detected by the detecting portion 224, and a driving gear 222 that rotates by the driving motor 221 to move the sliding member 213 frontward and rearward.

A rack gear 214 is formed on a side surface of the sliding member 213. The rack gear 214 is engaged with the driving gear 222.

When the pivot shaft 215 is formed on the sliding member 213, the door 3 pivots about the pivot shaft 215. Therefore, the detecting portion 224 is provided on the door 3 to detect relative rotation of the pivot shaft 215 to the pivot motion of the door 3. Alternatively, when the pivot shaft 215 is formed on the door 3, the detecting portion 224 is provided on the sliding member 213 to detect the pivot motion of the pivot shaft 215.

Therefore, when the door 3 pivots, the pivot motion of the door 3 is detected by the detecting portion 224 and the driving gear 222 rotates by the driving motor 221. By the rotation of the driving gear 222, the rack gear 214 engaged with the driving gear 22 is translated frontward and rearward. As the rack gear 214 is translated frontward and rearward, the pivot shaft 215 is translated frontward and rearward with respect to the front surface of the main body 2.

Since a coupling structure of the sliding member and the guide rail is identical to that of the foregoing embodiment of FIGS. 1 through 4, detailed description thereof will be omitted herein.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body defining a storage chamber;

a door opening and closing the storage chamber; and a pivot guide unit connecting the door to the main body and varying a distance between a pivot shaft of the door and the main body in response to a pivot motion of the door, the pivot guide unit including:

a sliding member pivotally connected to the door;

a guide rail installed at the main body and extended in a front-rear direction of the main body to guide sliding motion of the sliding member;

a first link member pivotally connected to the door;

a second link member pivotally connected to the first link member and the sliding member;

a stationary gear formed in parallel with the guide rail; and a movable gear connected to the second link member and engaged with the stationary gear to rotate together with the second link member.

2. The refrigerator according to claim 1, wherein, when the door pivots over a predetermined angle, the pivot angle of the door increases in a state where the distance between the pivot shaft and the main body is uniformly maintained.

3. The refrigerator according to claim 1, wherein the pivot shaft is translated with respect to a front surface of the main body in a direction perpendicular to the front surface.

4. The refrigerator according to claim 1, wherein the stationary gear is a rack gear and the movable gear is a pinion gear engaged with the rack gear such that a rotational center of the pinion gear moves as the pinion gear rotates.

5. The refrigerator according to claim 1, wherein the guide rail is provided with a stopper for stopping the sliding member when the sliding member slides by a predetermined distance.

6. The refrigerator according to claim 1, further comprising a connecting member connecting the second link member to the sliding member, the connecting member being configured to translate frontward and rearward when the door pivots.

7. The refrigerator according to claim 6, wherein the connecting member simultaneously penetrates second link member, the sliding member and the movable gear, and wherein the connecting member functions as a pivot shaft of the second link member and movable gear.

* * * * *